US010480799B2

(12) United States Patent
Yanase et al.

(10) Patent No.: US 10,480,799 B2
(45) Date of Patent: Nov. 19, 2019

(54) OUTDOOR UNIT

(71) Applicant: Mitsubishi Electric Corporation, Tokyo (JP)

(72) Inventors: Tomoya Yanase, Tokyo (JP); Toshiyuki Kubono, Tokyo (JP); Hiroyuki Jinnai, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/527,609

(22) PCT Filed: Feb. 17, 2015

(86) PCT No.: PCT/JP2015/054328
§ 371 (c)(1),
(2) Date: May 17, 2017

(87) PCT Pub. No.: WO2016/132456
PCT Pub. Date: Aug. 25, 2016

(65) Prior Publication Data
US 2017/0328585 A1 Nov. 16, 2017

(51) Int. Cl.
*F24F 1/22* (2011.01)
*F24F 13/22* (2006.01)
(Continued)

(52) U.S. Cl.
CPC ..... *F24F 1/22* (2013.01); *F24F 1/26* (2013.01); *F24F 13/20* (2013.01); *F24F 13/22* (2013.01)

(58) Field of Classification Search
CPC .... F24F 1/22; F24F 13/22; F24F 13/20; F24F 1/56; F24F 1/20
See application file for complete search history.

(56) References Cited

U.S. PATENT DOCUMENTS 6,053,004 A * 4/2000 Beppu ..... F24F 1/36 62/262
6,094,928 A * 8/2000 Oyabu ..... F24F 1/46 62/259.1
(Continued)

FOREIGN PATENT DOCUMENTS

CN 1219229 A 6/1999
CN 2773533 Y 4/2006
(Continued)

OTHER PUBLICATIONS

"Machine Translation of JP 07208770 A, Okada, Jan. 1994".*
(Continued)

*Primary Examiner* — Frantz F Jules
*Assistant Examiner* — Martha Tadesse
(74) *Attorney, Agent, or Firm* — Posz Law Group, PLC

(57) ABSTRACT

An outdoor unit connected to an indoor unit through a refrigerant pipe, including: a casing; a compressor accommodated inside the casing; a valve mounting plate positioned in an upper part inside the casing and above the compressor; a valve mounted on the valve mounting plate, to which the refrigerant pipe is connected; and a terminal block to which a first wiring drawn from outside of the casing is connected, the terminal block being accommodated inside the casing, in which the valve mounting plate includes a mounting portion on which the terminal block is provided, the mounting portion communicating an upper side on which the valve is provided and a lower side on which the controller is provided into communication with each other.

9 Claims, 11 Drawing Sheets

(51) Int. Cl.
*F24F 13/20* (2006.01)
*F24F 1/26* (2011.01)

(56) References Cited

U.S. PATENT DOCUMENTS

| | | | | |
|---|---|---|---|---|
| 8,850,832 | B2 * | 10/2014 | Lingrey | F24F 1/26 62/262 |
| 2010/0294466 | A1 * | 11/2010 | Shimaoka | F24F 1/24 165/104.33 |

FOREIGN PATENT DOCUMENTS

| | | | | | |
|---|---|---|---|---|---|
| JP | 07208770 | A | * | 8/1995 | |
| JP | 07208770 | A | * | 8/1995 | |
| JP | H09-236286 | A | | 9/1997 | |
| JP | 10246470 | A | * | 9/1998 | F24F 1/36 |
| JP | H10-253099 | A | | 9/1998 | |
| JP | H10-318564 | A | | 12/1998 | |
| JP | 11014100 | A | * | 1/1999 | |
| JP | 11037506 | A | * | 2/1999 | |
| JP | 11094305 | A | * | 4/1999 | |
| JP | 2001099449 | A | * | 4/2001 | |
| JP | 2008190806 | A | * | 8/2008 | |
| JP | 2008190806 | A | * | 8/2008 | |

OTHER PUBLICATIONS

"Machine Translation of JP 2008190806 A, Kuwayama, Feb. 2007".*
International Search Report of the International Searching Authority dated May 26, 2015 for the corresponding International application No. PCT/JP2015/054328 (and English translation).
Extended EP Search Report dated Sep. 20, 2018 issued in corresponding EP patent application No. 15882560.4.
Office Action dated Mar. 15, 2019 issued in corresponding CN patent application No. 201580075257.6 (and English translation).
Office Action dated Aug. 13, 2019 issued in corresponding CN patent application No. 201580075257.6 (and English translation).

* cited by examiner

OUTDOOR UNIT

CROSS REFERENCE TO RELATED APPLICATION

This application is a U.S. national stage application of International Application No. PCT/JP2015/054328, filed on Feb. 17, 2015, the contents of which are incorporated herein by reference.

TECHNICAL FIELD

The present invention relates to an outdoor unit for a refrigeration cycle apparatus.

BACKGROUND

Hitherto, in an outdoor unit for a refrigeration cycle apparatus such as an air-conditioning apparatus, for example, a compressor, a heat exchanger, a fan, and other components are accommodated inside a casing. Further, the outdoor unit for an air-conditioning apparatus is connected to an indoor unit in which a heat exchanger, a fan, and other components are accommodated through a refrigerant pipe. Then, in the air-conditioning apparatus, when the fan is driven, outside air is supplied to the heat exchanger. Further, when the compressor is driven, refrigerant circulates between the indoor unit and the outdoor unit.

There has been proposed an outdoor unit including a valve to which a refrigerant pipe drawn from the indoor unit side is connected is provided above the compressor as a related-art outdoor unit for an air-conditioning apparatus (see, for example, Patent Literature 1). The outdoor unit for an air-conditioning apparatus disclosed in Patent Literature 1 includes a bottom panel configured to form a bottom surface of an outdoor unit casing, a compressor placed on the bottom panel, a peripheral panel, which is arranged on the bottom panel, and is configured to form side surfaces of the outdoor unit casing, and a top panel, which is arranged on an upper end of the peripheral panel, and is configured to form a top surface of the outdoor unit casing.

In the outdoor unit for an air-conditioning apparatus disclosed in Patent Literature 1, the valve can be exposed by removing the top panel so that work for connection between the valve and the refrigerant pipe can be performed from an upper side of the outdoor unit casing.

PATENT LITERATURE

Patent Literature 1: Japanese Unexamined Patent Application Publication No. 10-253099

In the outdoor unit for an air-conditioning apparatus, an electrical component box including a controller configured to control the compressor or other components mounted therein is mounted. Further, some outdoor units for an air-conditioning apparatus include, for example, a terminal block configured to electrically connect wirings to each other. The terminal block connects the wiring connected to the indoor unit side and the wiring connected to the controller for the outdoor unit so as to achieve communication between the outdoor unit and the indoor unit.

In this case, the outdoor unit for an air-conditioning apparatus is generally installed outdoors. For example, when the outdoor unit is installed in an apartment, the outdoor unit is installed on a balcony. In a case of a single-family house, an installation space for the outdoor unit is easily ensured in a yard or other spaces. In the case of the balcony of the apartment, the installation space is often smaller than in the case of the single-family house or other cases. Thus, the installation space is likely to be limited. As described above, there is a request of size reduction not only for the indoor unit installed indoors but also for the outdoor unit installed outdoors.

However, when the size of the outdoor unit is reduced based on the request described above, there arises a problem in that a space for installing the terminal block or other components is unlikely to be ensured inside the outdoor unit.

SUMMARY

The present invention has been made to solve the problem described above, and has an object to provide an outdoor unit that enables effective use of a limited space inside a casing.

According to one embodiment of the present invention, there is provided an outdoor unit connected to an indoor unit through a refrigerant pipe, including: a casing, a compressor accommodated inside the casing, a valve mounting plate positioned in an upper part inside the casing and above the compressor, an electrical component box provided below the valve mounting plate, in which a controller configured to control a rotation speed of the compressor is provided, a valve mounted on the valve mounting plate, to which the refrigerant pipe is connected, and a terminal block to which a first wiring connected on a side of the indoor unit, in which the valve mounting plate includes a mounting portion on which the terminal block is provided, the mounting portion being configured to bring an upper side on which the valve is arranged and a lower side on which the controller is arranged into communication with each other.

The outdoor unit according to one embodiment of the present invention includes the above-mentioned configuration, and thus enables effective use of the limited space inside the casing.

DETAILED DESCRIPTION

Figure 1A:
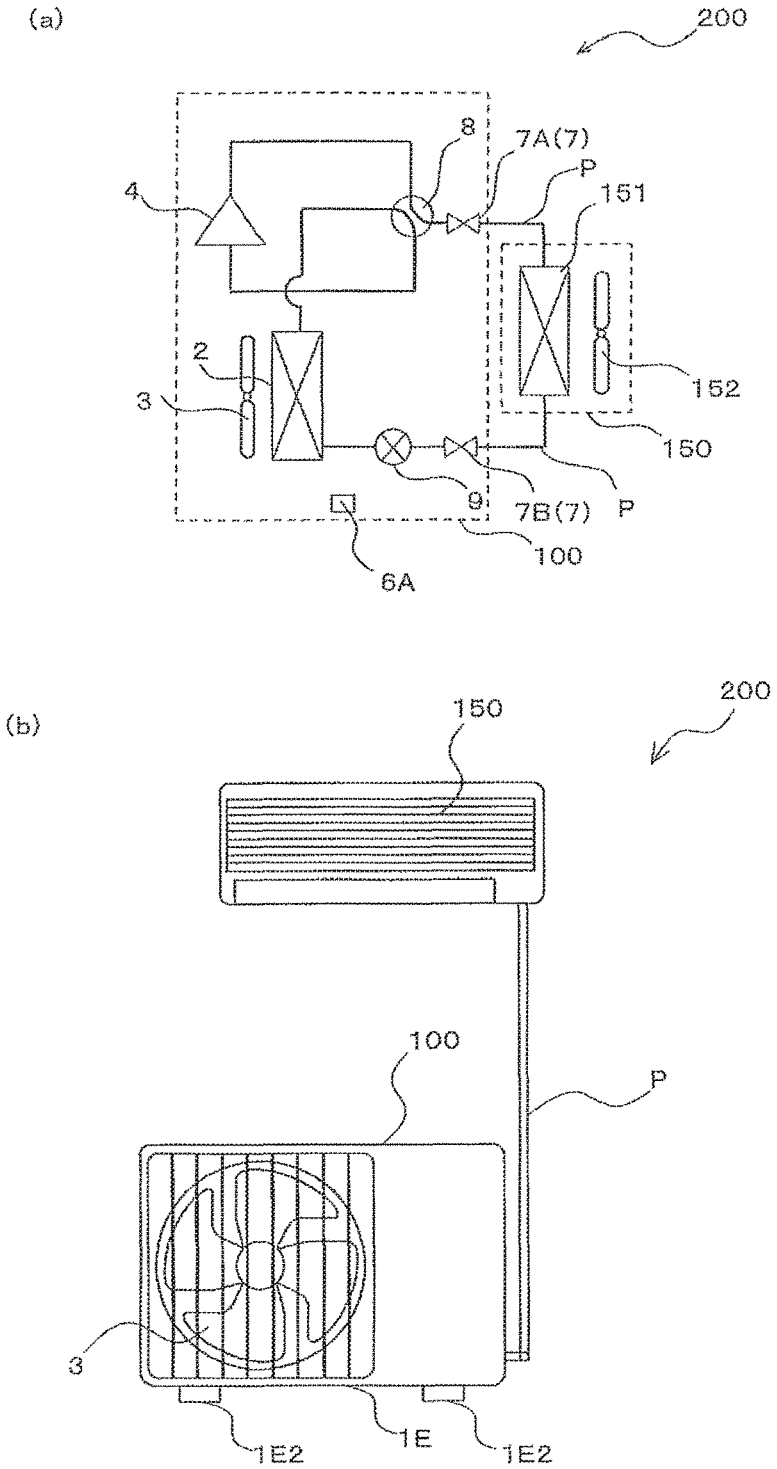
FIG. 1A are schematic diagrams of a refrigeration cycle apparatus including an outdoor unit according to Embodiment 1 of the present invention.

Now, an outdoor unit 100 according to Embodiments of the present invention is described with reference to the drawings. In the drawings referred to below including FIG. 1, components denoted by the same reference symbols correspond to the same or equivalent components. This is common throughout Embodiments described below.

Embodiment 1

FIG. 1A are schematic views of an air-conditioning apparatus 200 including the outdoor unit 100 according to Embodiment 1 of the present invention. An example of a configuration of a refrigerant circuit of the air-conditioning apparatus 200 is illustrated in FIG. 1A (a), and a state in which the outdoor unit 100 and an indoor unit 150 are connected by refrigerant pipes P is illustrated in FIG. 1A(b). In Embodiment 1, an example of a case where a refrigeration cycle apparatus is the air-conditioning apparatus 200 is described.

[Air-Conditioning Apparatus 200]

The air-conditioning apparatus 200 includes the indoor unit 150 and the outdoor unit 100, and is constituted by connection therebetween through the refrigerant pipes P. The indoor unit 150 includes an indoor heat exchanger 151 configured to function as an evaporator during a cooling operation and a condenser during a heating operation, and other components. Cooling energy or heating energy generated in the outdoor unit 100 is delivered to the indoor unit 150 through the refrigerant pipes P.

The outdoor unit 100 is arranged outside of, for example, a building, an apartment, a single-family house, or other constructions, and is configured to supply the cooling energy or the heating energy to the indoor unit 150 through the refrigerant pipes P. In the outdoor unit 100, a compressor 4 configured to compress refrigerant, a four-way valve 8 configured to switch a flow passage, an expansion device 9 configured to reduce a pressure of the refrigerant, an outdoor heat exchanger 2 configured to exchange heat between air and the refrigerant, and a fan 3 configured to supply the air to the outdoor heat exchanger 2, and other components are mounted.

The indoor unit 150 is arranged at a position at which cooling air or heating air can be supplied to an air-conditioned space, for example, an indoor space, and is configured to supply the cooling air or the heating air to the air-conditioned space. In the indoor unit 150, the indoor heat exchanger 151 configured to exchange heat between the air and the refrigerant and a fan 152 configured to supply the air to the indoor heat exchanger 151 are mounted.

The indoor heat exchanger 151, the four-way valve 8, and the expansion device 9 are now described. The indoor heat exchanger 151 is configured to exchange heat between indoor air taken into the indoor unit 150 by the fan 152 and the refrigerant so as to condense and liquefy the refrigerant during the heating operation and evaporate and gasify the refrigerant during the cooling operation. The four-way valve 8 is configured to switch a flow of the refrigerant between a flow of the refrigerant during the heating operation and a flow of the refrigerant during the cooling operation and a defrosting operation. The four-way valve 8 is configured to connect a discharge side of the compressor 4 and the indoor heat exchanger 151 and to connect a suction side of the compressor 4 and the outdoor heat exchanger 2 during the heating operation. Further, the four-way valve 8 is configured to connect the discharge side of the compressor 4 and the outdoor heat exchanger 2 and to connect the suction side of the compressor 4 and the indoor heat exchanger 151 during the cooling operation and the defrosting operation. The expansion device 9 is configured to reduce the pressure of the refrigerant flowing through the refrigerant circuit to expand the refrigerant. One side of the expansion device 9 is connected to the outdoor heat exchanger 2, whereas an other side thereof is connected to the indoor heat exchanger 151. The expansion device 9 only needs to be made up of a device having a variably controllable opening degree, for example, an electronic expansion valve. The remaining configuration (including the compressor 4 and other components) is described later.

Next, a refrigeration cycle operation of a refrigerant circuit illustrated in FIG. 1A(a) is described with reference to FIG. 1A(a). In this case, the flow of the refrigerant during the heating operation is described. At start of the heating operation, the four-way valve 8 switches the flow passage as illustrated in FIG. 1A(a). Gaseous refrigerant compressed and discharged by the compressor 4 flows into the indoor heat exchanger 151 via the four-way valve 8. The gaseous refrigerant flowing into the indoor heat exchanger 151 exchanges heat with the indoor air supplied from the fan 152 to be condensed, and flows out of the indoor heat exchanger 151. The refrigerant flowing out of the indoor heat exchanger 151 flows into the expansion device 9, and is expanded and reduced in pressure by the expansion device 9. The pressure-reduced refrigerant flows into the outdoor heat exchanger 2 and exchanges heat with outdoor air supplied from the fan 3 to be gasified, and flows out of the outdoor heat exchanger 2. The gaseous refrigerant flowing out of the outdoor heat exchanger 2 is sucked by the compressor 4 through the four-way valve 8.

[Outer Shell of Outdoor Unit 100]

Figure 1B:
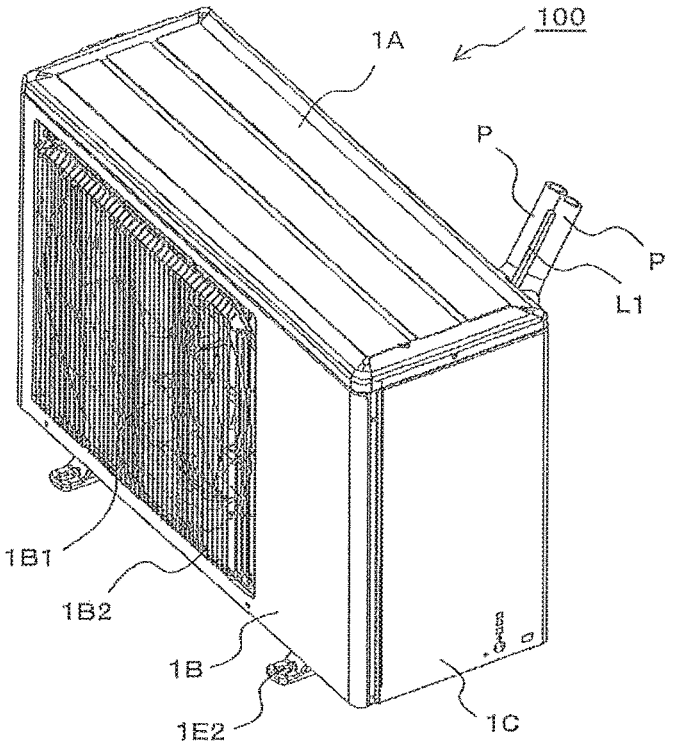
FIG. 1B is a front perspective view of the outdoor unit according to Embodiment 1 of the present invention.
Figure 1C:
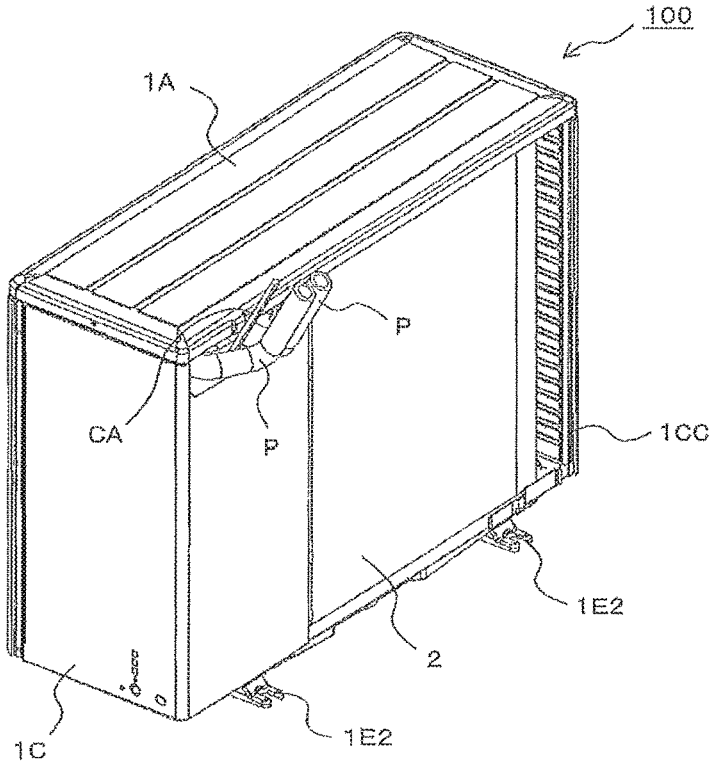
FIG. 1C is a back perspective view of the outdoor unit according to Embodiment 1 of the present invention.
Figure 1D:
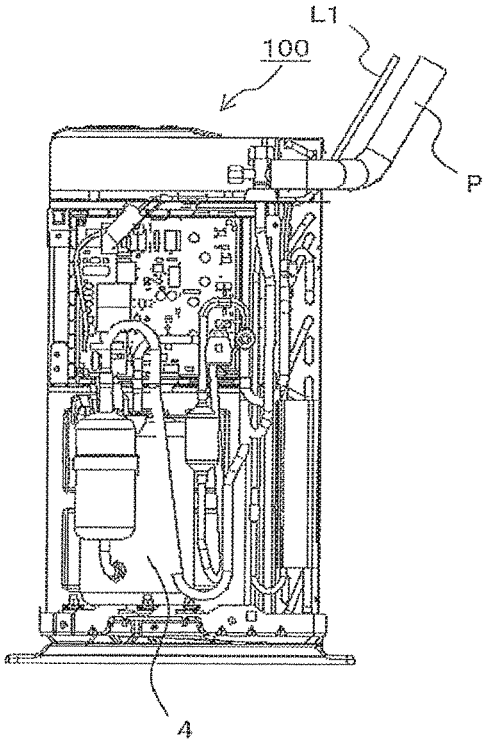
FIG. 1D is a view of an internal structure and other parts of the outdoor unit according to Embodiment 1 of the present invention, as viewed from a side surface side of the outdoor unit.
Figure 1E:
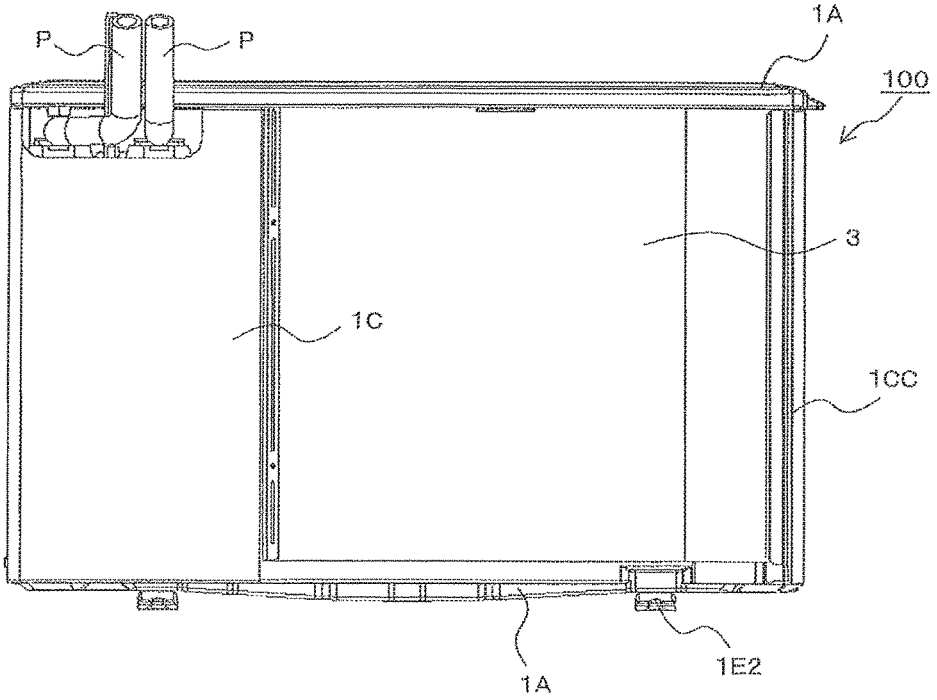
FIG. 1E is a back surface view of the outdoor unit according to Embodiment 1 of the present invention.
Figure 1F:
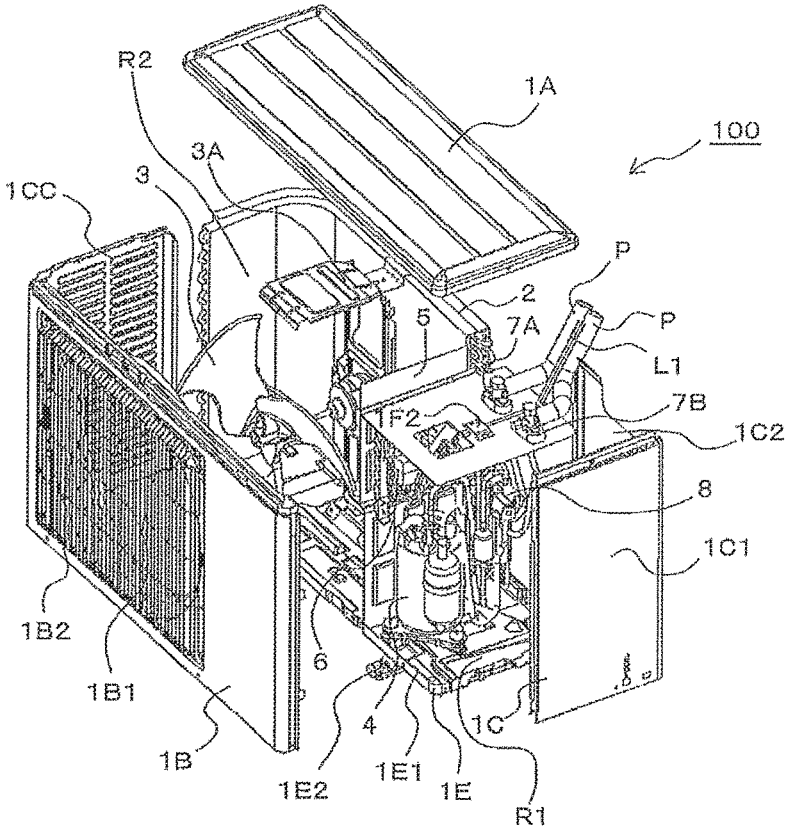
FIG. 1F is a perspective view of a state in which the outdoor unit according to Embodiment 1 of the present invention is exploded.

FIG. 1B is a front perspective view of the outdoor unit 100 according to Embodiment 1 of the present invention. FIG. 10 is a back perspective view of the outdoor unit 100 according to Embodiment 1 of the present invention. FIG. 1D is a view of an internal structure and other parts of the indoor unit 100 according to Embodiment 1 as viewed from a side surface side of the outdoor unit 100. FIG. 1E is a back view of the outdoor unit 100 according to Embodiment 1. FIG. 1F is a perspective view in a state in which the outdoor unit 100 according to Embodiment 1 is exploded.

The outdoor unit 100 includes the outdoor heat exchanger 2 configured to function as a condenser during the cooling operation and function as an evaporator during the heating operation, and other components. In the following description, a front panel 1B is defined as a front surface (front side) of the outdoor unit. A side on which a first side panel 1CC is arranged with respect to the front side is defined as a left side. A side on which a second side panel 1C is arranged with respect to the front side is defined as a right side.

A casing of the outdoor unit 100 includes a top panel 1A configured to form an upper surface of the indoor unit 100, the front panel 1B configured to form the front surface of the outdoor unit 100, the first side panel 1CC configured to form a left side surface of the outdoor unit 100, the second side panel 1C configured to form a right side surface of the outdoor unit 100, and a fan grille 1B2, which is provided to the front panel 1B, and is configured to form a part of the front surface of the outdoor unit 100, and a bottom panel 1E configured to form a bottom surface of the outdoor unit 100. The front panel 1B, the first side panel 1CC, and the second side panel 1C are arranged on a peripheral edge portion 1E1 of the bottom panel 1E so as to be provided upright on the bottom panel 1E. In this case, the second side panel 1C corresponds to a peripheral panel.

(Top Panel 1A)

The top panel 1A forms the upper surface of the outdoor unit 100. The top panel 1A is provided to an upper end portion of the peripheral panel so as to cover an upper portion of the outdoor heat exchanger 2. The top panel 1A has a front side end portion and a left side end portion respectively held in contact with the front panel 1B and the first side panel 1CC so as to be supported thereby and a right side end portion held in contact with the second side panel 1C so as to be supported thereby. The top panel 1A is formed of, for example, a metal plate.

(Front Panel 1B and First Side Panel 1CC)

The front panel 1B forms a part of the front surface of the outdoor unit 100. The first side panel 1CC is provided to a left side end portion of the front panel 1B, whereas the second side panel 1C is provided to a right side end portion thereof. In Embodiment 1, the first side panel 1CC and the front panel 1B are coupled to be formed integrally.

The front panel 1B has a lower end portion provided on the peripheral edge portion 1E1 of the bottom panel 1E and an upper end portion on which the top panel 1A is provided. Further, a right end portion of the portion of the front panel 1B, which forms the front surface, is provided so as to extend along a front side end portion of the second side panel 1C. Further, an opening port 1B1 having a circular shape, for example, serving as an outside air suction port is formed in the front panel 1B. The fan grille 1B2 is provided so as to be opposed to a position at which the opening port 1B1 is formed. The front panel 1B is formed of, for example, a resin.

The first side panel 1CC is provided on the peripheral edge portion 1E1 of the bottom panel 1E. Then, the first side panel 1CC is provided to a portion corresponding to one short side of the bottom panel 1E. The second side panel 1C is arranged at a position opposed to the first side panel 1CC. A front-side side surface portion of the first side panel 1CC is provided so as to extend along a side end portion of a cover 1D. A plurality of opening ports are formed in the first side panel 1CC so that the air is supplied to the outdoor heat exchanger 2.

(Second Side Panel 1C)

The second side panel 1C forms a part of a rear surface and a right side surface of the outdoor unit 100. The second side panel 1C has an approximately L-like horizontal cross-sectional shape, is provided vertically upright on the bottom panel 1E, and is arranged on a lateral side and a rear side of the compressor 4. Specifically, the second side panel 1C includes a side surface portion 1C1 positioned on the lateral side of the compressor 4, which is parallel to the first side panel 1CC and a partition plate 5, and a back surface portion 1C2 positioned on a back surface side of the compressor 4, which is parallel to the front panel 1B (see FIG. 1L). The second side panel 1C has a front-side end portion provided along a side end portion of the cover 1D, an upper end portion held in contact with the top panel 1A, and a lower end portion held in contact with the bottom panel 1E. The second side panel 1C is formed of, for example, an ABS resin.

(Fan Grille 1B2)

The fan grille 1B2 forms a part of the front surface of the outdoor unit 100 and is used so as to prevent a user or other persons from being injured by the fan 3 or other components. The fan grille 1B2 is, for example, a grid member including longitudinal bars and horizontal bars.

(Bottom Panel 1E)

The bottom panel 1E forms a part of the bottom surface of the outdoor unit 100. The bottom panel 1E is a rectangular member arranged below the compressor 4, the outdoor heat exchanger 2, and other components, and is configured to support the compressor 4 and the outdoor heat exchanger 2. On a peripheral edge of the bottom panel 1E, the peripheral edge portion 1E1 provided vertically upright is formed. Specifically, the peripheral edge portion 1E1 is a flange-like portion formed at the peripheral edge portion of the bottom panel 1E. On the bottom panel 1E, the outdoor heat exchanger 2, the compressor 4, the partition plate 5, and other components are arranged. The bottom panel 1E is formed of, for example, a metal plate. Further, on a lower surface side of the bottom panel 1E, leg portions 1E2 used to place the outdoor unit 100 thereon are provided.

[Configuration Inside Casing of Outdoor Unit 100]

Figure 1G:
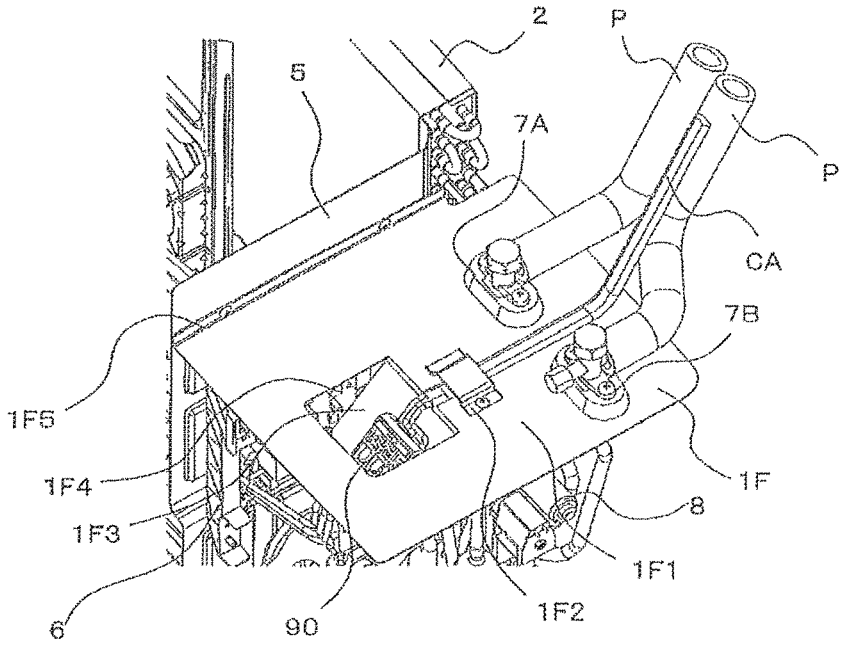
FIG. 1G is a perspective view of a valve mounting plate of the outdoor unit according to Embodiment 1 of the present invention and a periphery thereof.
Figure 1H:
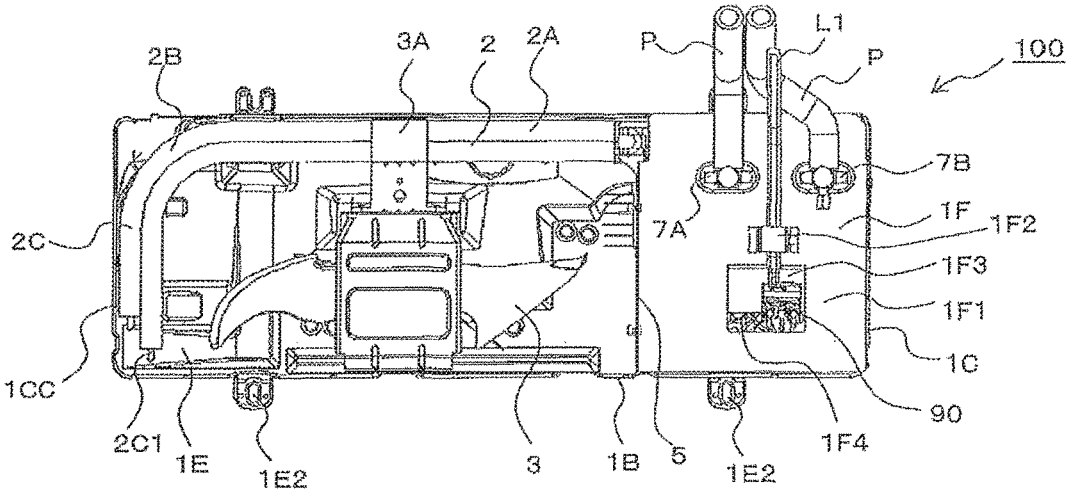
FIG. 1H is a view of the outdoor unit as viewed from above in a state in which a top panel of the outdoor unit according to Embodiment 1 of the present invention is removed.
Figure 1I:
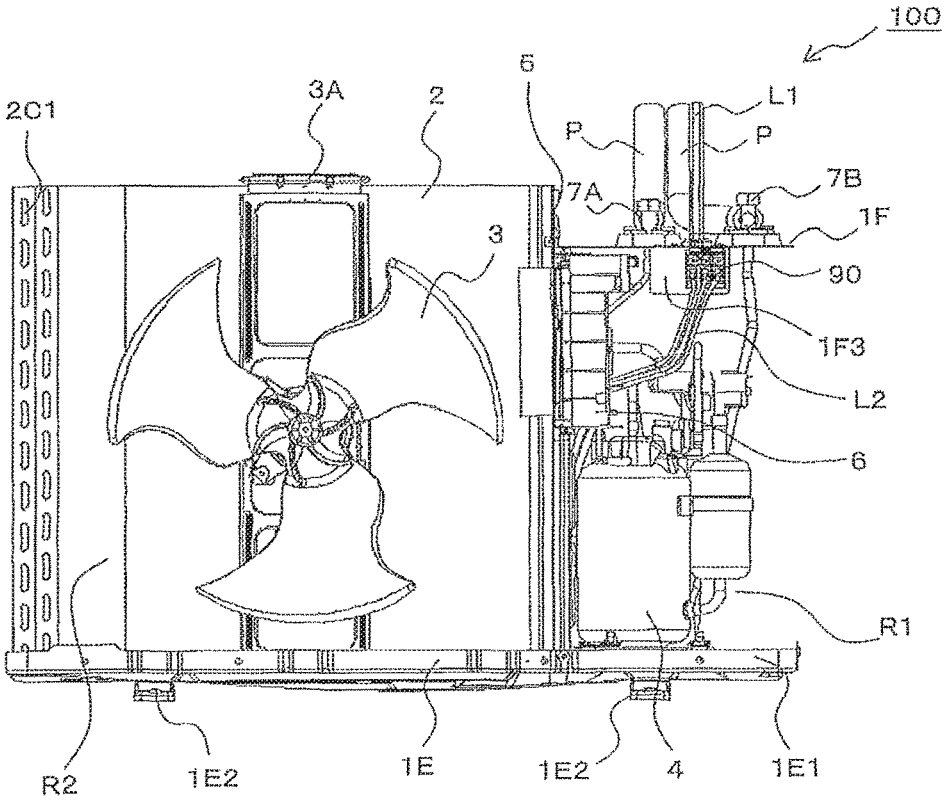
FIG. 1I is a front view of the outdoor unit according to Embodiment 1 of the resent invention in a state in which a front panel, a first side panel, a second side panel, and a top panel are removed.

FIG. 1G is a perspective view of a valve mounting plate 1F of the outdoor unit 100 according to Embodiment 1 and a periphery thereof. FIG. 1H is a view of the outdoor unit 100 as viewed from above in a state in which the top panel 1A of the outdoor unit 100 according to Embodiment 1 is removed. FIG. 1I is a front view of the outdoor unit 100 according to Embodiment 1 in which the front panel 1B, the first side panel 1CC, the second side panel 1C, and the top panel 1A are removed. With reference to FIG. 1G to FIG. 1I, configurations of the partition plate 5, the compressor 4, the outdoor heat exchanger 2, and other components provided inside the casing of the compressor 4 are described.

In the outdoor unit 100, the partition plate 5 configured to partition a space inside the outdoor unit 100 into a left side and a right side, the compressor 4 configured to compress and discharge the refrigerant, the outdoor heat exchanger 2 having an L-like horizontal cross-sectional shape, the fan 3 configured to supply outside air to the outdoor heat exchanger 2, a motor support 3A configured to hold the fan 3, the four-way valve 8 configured to switch the flow passage, and other components are mounted.

Further, in the outdoor unit 100, an electrical component box 6 in which a controller 6A (see FIG. 1A(a)) configured to control a rotation speed of the compressor 4 and other components is provided, and a terminal block 90 connected to the indoor unit 150 side through a first wiring L1 and connected to the controller 6A through a second wiring L2 are mounted.

Further, the outdoor unit 100 includes valves 7 to which the refrigerant pipes P are connected and the valve mounting plate 1F to which the valves 7 are mounted. The terminal block 90 is installed on the valve mounting plate 1F.

(Partition Plate 5)

The partition plate 5 is arranged so as to define a side on which the compressor 4, the valves 7, the electrical component box 6, and other components are arranged, and a side on which the outdoor heat exchanger 2, the fan 3, the motor support 3A, and other components are arranged. Specifically, the partition plate 5 is configured to define a machine room R1 in which the compressor 4, the valves 7, and the electrical component box 6, and other components are provided, and a fan room R2 in which the outdoor heat exchanger 2, the fan 3, the motor support 3A, and other components are provided. The partition plate 5 is arranged, for example, on the bottom panel 1E. The partition plate 5 has, for example, a front end portion arranged on the front panel 1B and a rear end portion fixed to an end portion of the outdoor heat exchanger 2. Further, one end side of the valve mounting plate 1F is fixed to a surface on the machine room R1 side. Specifically, the valve mounting plate 1F is fixed to the partition plate 5 so as to be supported above the compressor 4.

(Compressor 4)

The compressor 4 is configured to suck the refrigerant, compress the refrigerant into a high-temperature and high-pressure state, and discharge the refrigerant. The compressor 4 is connected to the four-way valve 8 configured to switch the flow of the refrigerant to switch the cooling operation and the heating operation through a pipe. The compressor 4 is accommodated within the casing of the outdoor unit 100. Around the compressor 4, the partition plate 5, the front panel 1B, the second side panel 1C, and other components are arranged. For example, the partition plate 5 is arranged on a left lateral side of the compressor 4, the side surface portion 1C1 of the second side panel 1C is arranged on a right lateral side of the compressor 4, and the back surface portion 1C2 of the second side panel 1C is arranged on a back surface side of the compressor 4.

Above the compressor 4, the electrical component box 6 used for various types of control and other purposes is provided. Further, above the compressor 4 and above the electrical component box 6, the valve mounting plate 1F is arranged. The compressor 4 is not required to be directly placed on the bottom panel 1E, and may also be placed on an installation table provided on the bottom panel 1E.

(Outdoor Heat Exchanger 2, Fan 3, and Motor Support 3A)

The outdoor heat exchanger 2 is configured to exchange heat between the air taken into the outdoor unit 100 by the fan 3 and the refrigerant so as to condense and liquefy the refrigerant during the cooling operation and evaporate and gasify the refrigerant during the heating operation. The outdoor heat exchanger 2 is provided, for example, on the bottom panel 1E. The outdoor heat exchanger 2 is not required to be directly placed on the bottom panel 1E, and may also be placed on an installation table provided on the bottom panel 1E. On a top of the outdoor heat exchanger 2, the motor support 3A is provided in a hooked manner. The outdoor heat exchanger 2 is made up of, for example, a fin and tube heat exchanger capable of exchanging heat between the refrigerant flowing through a heat transfer tube and air passing through a fin.

The outdoor heat exchanger 2 includes a first heat exchange portion 2A extending in parallel to a direction from the first side panel 1CC to the second side panel 1C, a second heat exchange portion 2B being bent, and a third heat exchange portion 2C provided so as to be opposed to the first side panel 1CC. The first heat exchange portion 2A and the second heat exchange portion 2B are connected, and the second heat exchange portion 2B and the third heat exchange portion 2C are connected (see FIG. 1H). A refrigerant circulation member (not shown), for example, a header configured to distribute the refrigerant to various pipes and heat transfer tubes is arranged at an end portion of the outdoor heat exchanger 2, which is closer to the second side panel 1C. A hairpin 2C1 formed by bending the heat transfer tube into a semi-circular shape is provided to the third heat exchange portion 2C.

The outdoor heat exchanger 2, the fan 3, and the motor support 3A are accommodated inside the casing of the outdoor unit 100.

(Four-Way Valve 8)

The four-way valve 8 is switched so as to connect the indoor heat exchanger 151 functioning as the condenser and the discharge side of the compressor 4 to each other and to connect the outdoor heat exchanger 2 functioning as the evaporator and the suction side of the compressor 4 to each other during the heating operation. Further, the four-way valve 8 is switched so as to connect the outdoor heat exchanger 2 functioning as the condenser and the discharge side of the compressor 4 to each other and to connect the indoor heat exchanger 151 functioning as the evaporator and the suction side of the compressor 4 to each other during the cooling operation. The four-way valve 8 is controlled by the controller 6A.

The four-way valve 8 is arranged between the compressor 4 and the back surface portion 1C2 of the second side panel 1C in a depth direction parallel to a horizontal direction. Further, the four-way valve 8 is arranged above the compressor 4 and below the valve mounting plate 1F in a vertical direction.

(Electrical Component Box 6)

The electrical component box 6 is a boxy body in which the controller 6A (see FIG. 1A(a)) and other components are mounted. Specifically, the electrical component box 6 protects the controller 6A so as to prevent the controller 6A from becoming faulty due to water, dust, and other factors. The electrical component box 6 is mounted to a surface of the partition plate 5, which is closer to the machine room R1. The electrical component box 6 is arranged below the valve mounting plate 1F. As a method used to mount the electrical component box 6 to the partition plate 5, a screw or other methods may be used. A fitting structure such as a claw may be used. An adhesive or other methods can be used.

The controller 6A provided inside the electrical component box 6 is connected to the terminal block 90 through the second wiring L2.

(Terminal Block 90)

The terminal block 90 is installed on the valve mounting plate 1F. A method used to fix the terminal block 90 onto the valve mounting plate 1F is not particularly limited. For example, a screw or other methods may be used. A fitting structure such as a claw may be used. An adhesive or other methods can be used. In this case, a terminal (not shown) to be mounted to the terminal block 90 is provided to a distal end of the first wiring L1. The terminal of the first wiring L1 is mounted onto the terminal block 90 so as to achieve electrical conduction between the first wiring L1 and the second wiring L2.

(Valves 7)

The valves 7 are mounted onto the valve mounting plate 1F. The valves 7 include a valve 7A and a valve 7B. The refrigerant pipes P are connected respectively to the valves 7. The valves 7 are arranged in a closed space formed between an upper surface of the valve mounting plate 1F and a lower surface of the top panel 1A. Therefore, when heat-insulating covers wound around outer sides of the refrigerant pipes P that connect an inside and an outside of the casing of the outdoor unit 100 take fire, a flame can be prevented from spreading into the machine room R1. Specifically, flame spreading can be blocked by the valve mounting plate 1F so that the flame can be prevented from reaching the compressor 4, the outdoor heat exchanger 2, or other components.

[Valve Mounting Plate 1F and Valves 7]

Figure 1J:
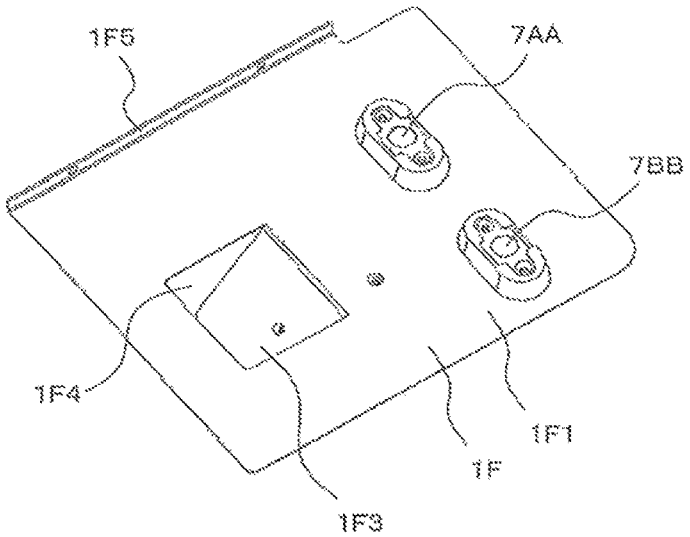
FIG. 1J is a perspective view of the valve mounting plate of the outdoor unit according to Embodiment 1 of the present invention.
Figure 1K:
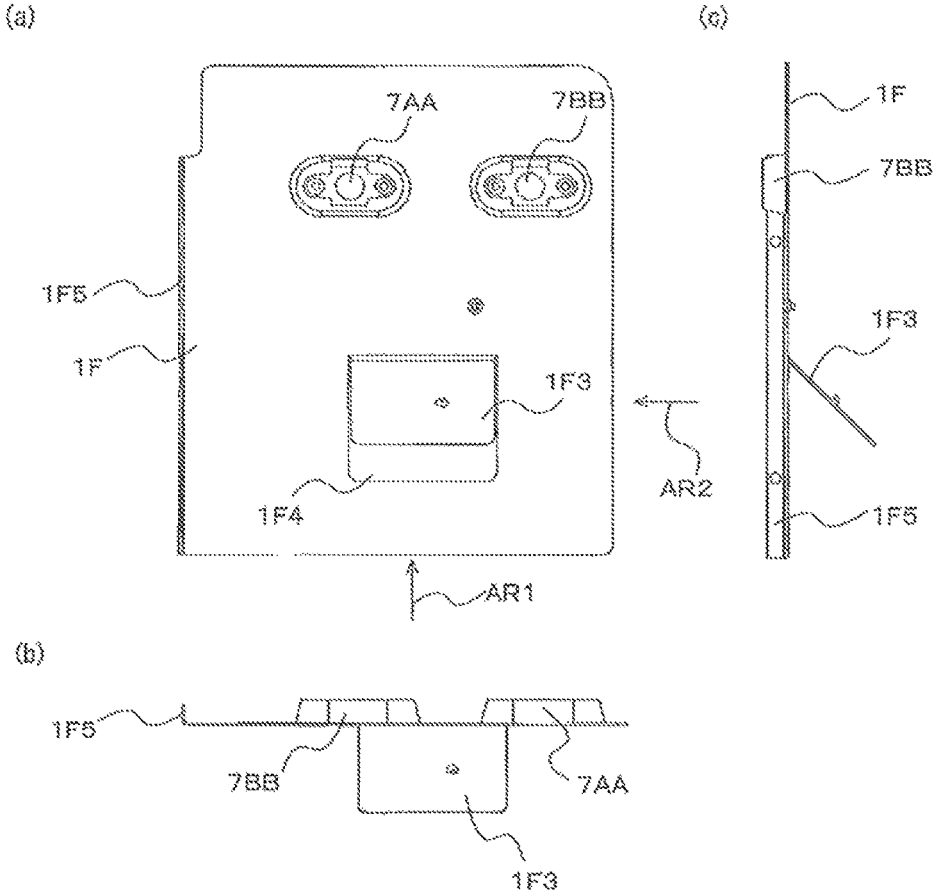
FIG. 1K are explanatory views of the valve mounting plate of the outdoor unit according to Embodiment 1 of the present invention.

FIG. 1J is a perspective view of the valve mounting plate 1F of the outdoor unit 100 according to Embodiment 1. FIG. 1K are explanatory views of the valve mounting plate 1F of the outdoor unit 100 according to Embodiment 1. FIG. 1K(a) is a top view of the valve mounting plate 1F. FIG. 1K(b) is a view of the valve mounting plate 1F as viewed from a side indicated by the arrow AR1, and FIG. 1K(c) is a view of the valve mounting plate 1F as viewed from a side indicated by the arrow AR2.

The valve mounting plate 1F includes a plate main body 1F1 having a rectangular shape, a fixing member 1F2 configured to fix the first wiring L1 onto an upper surface of the plate main body 1F1, a terminal block supporting unit 1F3 on which the terminal block 90 is installed, an opening port 1F4 formed in a portion in which the terminal block supporting unit 1F3 is formed, and a flange portion 1F5 to be fixed to the partition plate 5. In this case, the terminal box supporting portion 1F3 and the opening port 1F4 are configurations corresponding to a mounting portion. In Embodiment 1, the mounting portion includes the terminal block supporting portion 1F3 and the opening port 1F4.

The plate main body 1F1 having a rectangular shape is described as an example in Embodiment 1. A valve mounting portion 7AA to which the valve 7A is mounted and a valve mounting portion 7BB to which the valve 7B is mounted are provided on the plate main body 1F1. The fixing member 1F2 is fixed onto the plate main body 1F1 by, for example, a screw. The opening port 1F4 is formed in the plate main body 1F1 on a line extended in a direction from the valve mounting portion 7AA and the valve mounting portion 7BB toward the fixing member 1F2. Further, the terminal block supporting portion 1F3 having a slope surface inclined downward is formed in the plate main body 1F1 at a position where the opening port 1F4 is formed. Further, the flange portion 1F5 formed by upward bending is formed at an end portion of the plate main body 1F1, which is closer to the partition plate 5.

The fixing member 1F2 corresponds to a cable clamp or other members. The fixing member 1F2 is fixed to the plate main body 1F1 by a screw or other methods in a state in which the first wiring L1 is fixed onto the plate main body 1F1. The fixing member 1F2 is provided between the valve mounting portion 7AA to which the valve 7A is mounted and the valve mounting portion 7BB to which the valve 7B is mounted, and the opening port 1F4.

The terminal block supporting portion 1F3 is a plate-like member having one end portion connected to a peripheral edge of the opening port 1F4 and a slope surface inclined downward from the one end to an other end. The terminal block 90 is provided on the terminal block supporting portion 1F3. The terminal block supporting portion 1F3 is connected to a portion of the peripheral edge of the opening port 1F4, which is on a side closer to the valves 7. Specifically, the opening port 1F4 has a rectangular shape in Embodiment 1. The terminal block supporting portion 1F3 is connected to one side of four sides of the opening port 1F4 having the rectangular shape, which is positioned on the side closer to the valves 7. In this manner, the first wiring L1 inside the casing of the outdoor unit 100 can be linearly drawn to be connected to the terminal block 90. For example, when the terminal block supporting portion 1F3 is connected to the portion of the peripheral edge of the opening port 1F4, which is closer to the partition plate 5, the first wiring L1 is required to be connected to the terminal block 90 so as to extend along a U-like pattern. As described above, in the outdoor unit 100 according to Embodiment 1, complication of the drawing of the first wiring L1 can be avoided as described above.

The opening port 1F4 is formed so as to bring the machine room R1 being a space below the valve mounting plate 1F, in which the compressor 4 and other members are installed, and a space above the valve mounting plate 1F into communication with each other. In Embodiment 1, the example of the opening port having the rectangular shape is described as an example. The first wiring L1 passes through the opening port 1F4.

The flange portion 1F5 is formed at an end portion on the side closer to the partition plate 5 by upward bending. The flange portion 1F5 is fastened to the partition plate 5 by, for example, a screw. As a result, the valve mounting plate 1F is supported above the compressor 4.

[Second Side Panel 1C]

Figure 1L:
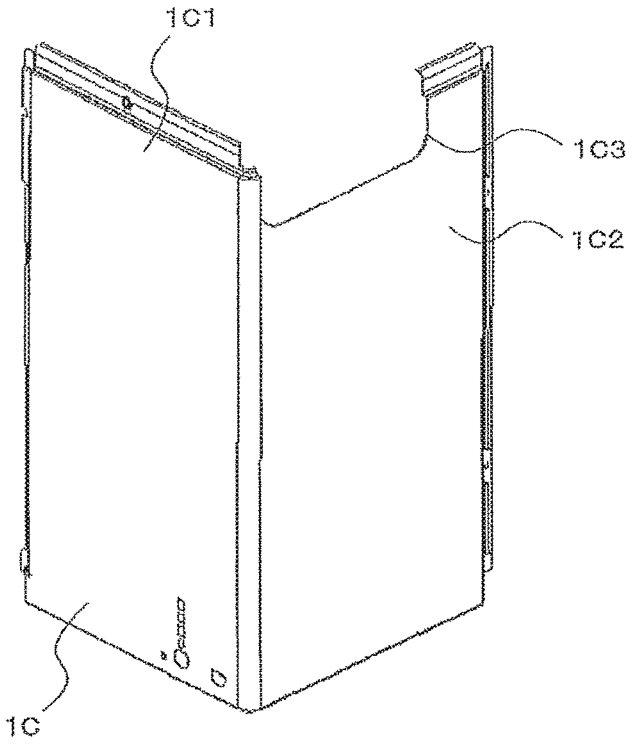
FIG. 1L is a perspective view of the second side panel of the outdoor unit according to Embodiment 1 of the present invention.

FIG. 1L is a perspective view of the second side panel 1C of the outdoor unit 100 according to Embodiment 1. A configuration of the second side panel 1C is described with reference to FIG. 1L. The second side panel 1C corresponding to the peripheral panel is arranged on a side of the partition plate 5 as a boundary, on which the compressor 4 is provided. The top panel 1A is mounted on an upper end portion thereof.

The second side surface panel 1C includes a side surface portion 1C1 arranged on a portion of the peripheral edge portion 1E1 of the bottom surface panel 1E, which is positioned on a right lateral side of the compressor 4, and a back surface portion 1C2 arranged on a portion of the peripheral edge portion 1E1 of the bottom surface panel 1E, which is positioned on the back surface side of the compressor 4. The back surface portion 1C2 has a cutout portion 1C3 formed at a height position on an upper portion of the valve mounting plate 1F, through which the refrigerant pipes P extends. In the outdoor unit 100, by the formation of the cutout portion 1C3 in the second side surface panel 1C, the valves 7 and the indoor unit 150 are connected to each other with the refrigerant pipes P.

[Effects of Outdoor Unit 100 According to Embodiment 1]

The outdoor unit 100 according to Embodiment 1 includes the terminal block 90 provided on the valve mounting plate 1F provided above the compressor 4. Therefore, the limited space inside the casing of the outdoor unit 100 can be effectively utilized. Specifically, a space above the machine room R1 is a dead space. The valve mounting plate 1F includes the terminal block supporting portion 1F3 positioned in the space above the machine room R1. Therefore, in the outdoor unit 100 according to Embodiment 1, the terminal block 90 can be arranged in the dead space. Thus, the limited space inside the casing of the outdoor unit 100 can be effectively utilized.

In the outdoor unit 100 according to Embodiment 1, the wiring is easily drawn, which can suppress complication of a structure inside the casing of the outdoor unit 100. As a method of drawing the second wiring L2 from a portion below the valve mounting plate 1F to a portion thereabove, for example, a method of inserting the second wiring L2 into a gap formed between an end of the valve mounting plate 1F and the casing of the outdoor unit 100 is conceivable if the opening port 1F4 is not formed. With this method, however, the second wiring L2 is required to be drawn to the end of the valve mounting plate 1F, resulting in complication of the drawing of the wiring. The outdoor unit 100 according to Embodiment 1 can suppress the complication described above.

The outdoor unit 100 according to Embodiment 1 is described for a mode in which the terminal block supporting portion 1F3 corresponding to a portion of the mounting portion is a plate member having a slope formed thereon. However, the terminal block supporting portion 1F3 is not limited thereto. For example, the terminal block supporting portion 1F3 may be a mode including a vertical portion connected to the peripheral edge of the opening ort 1F4, being parallel to the vertical direction, and a horizontal portion connected to the vertical portion so as to be perpendicular thereto, on which the terminal block 90 is installed. As described above, even when the terminal block supporting portion 1F3 is formed in a stepwise manner, the same effects as those obtained by the outdoor unit 100 according to Embodiment 1 can be obtained.

The outdoor unit 100 according to Embodiment 1 in which the mounting portion includes the terminal block supporting portion 1F3 is described. However, the mounting portion is not limited thereto. For example, the terminal block 90 may be mounted to a lower surface portion of the plate main body 1F1 at a peripheral edge portion of a position at which the opening port 1F4 is formed. As described above, even when the plate main body 1F1 is provided with the functions of the terminal block supporting portion 1F3, the same effects as those obtained by the outdoor unit 100 according to Embodiment 1 can be obtained.

Embodiment 2

Figure 2A:
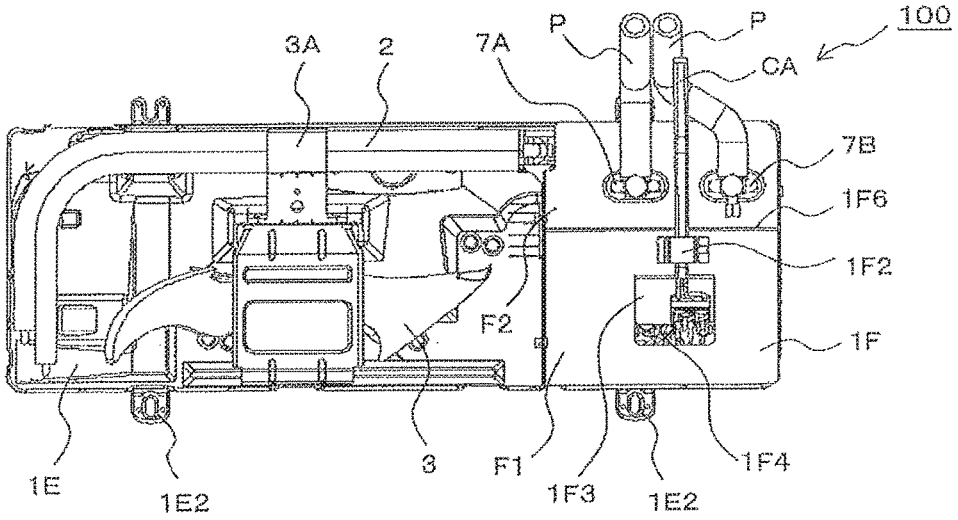
FIG. 2A is a view of an outdoor unit according to Embodiment 2 of the present invention as viewed from above in a state in which a top panel of the outdoor unit is removed.
Figure 2B:
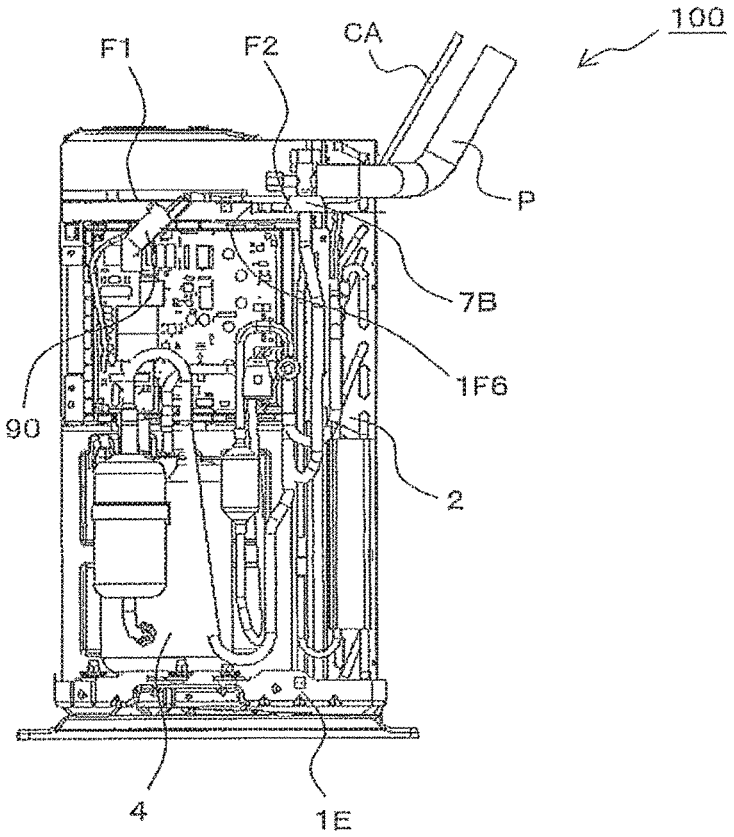
FIG. 2B is a view of an internal structure and other parts of the outdoor unit according to Embodiment 2 of the present invention as viewed from a side surface side of the outdoor unit.
Figure 2C:
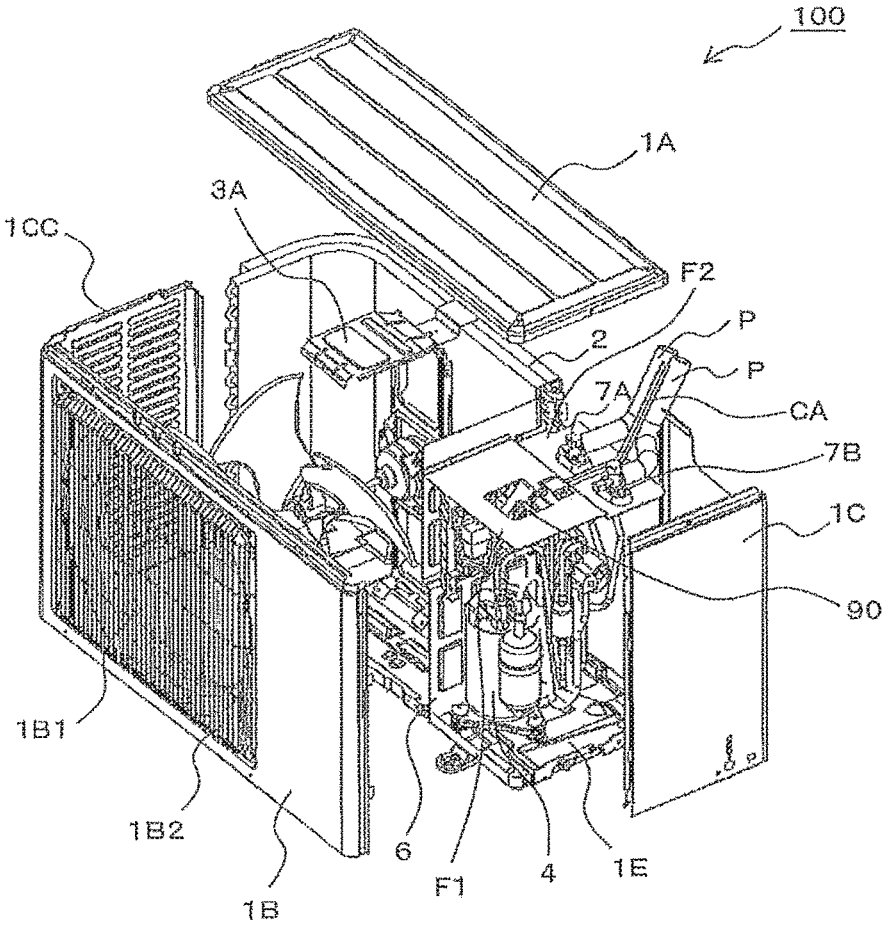
FIG. 2C is a perspective view in a state in which the outdoor unit according to Embodiment 2 of the present invention is exploded.

FIG. 2A is a view of the outdoor unit 100 as viewed from above in a state in which the top panel 1A of the outdoor unit 100 according to Embodiment 2 is removed. FIG. 2B is a view of an internal structure and other parts of the indoor unit 100 according to Embodiment 2 as viewed from a side surface side of the outdoor unit 100. FIG. 2C is a perspective view in a state in which the outdoor unit 100 according to Embodiment 2 is exploded. In Embodiment 2, differences from Embodiment 1 are mainly described, and configurations common to those of Embodiment 1 are denoted by the same reference symbols.

In Embodiment 2, only the valve mounting plate 1F described in Embodiment 1 is changed. Respective configurations of the compressor 4, the partition plate 5, and other components illustrated in FIG. 2A to FIG. 2C remain unchanged from those of Embodiment 1.

[Valve Mounting Plate 1FF]

Figure 2D:
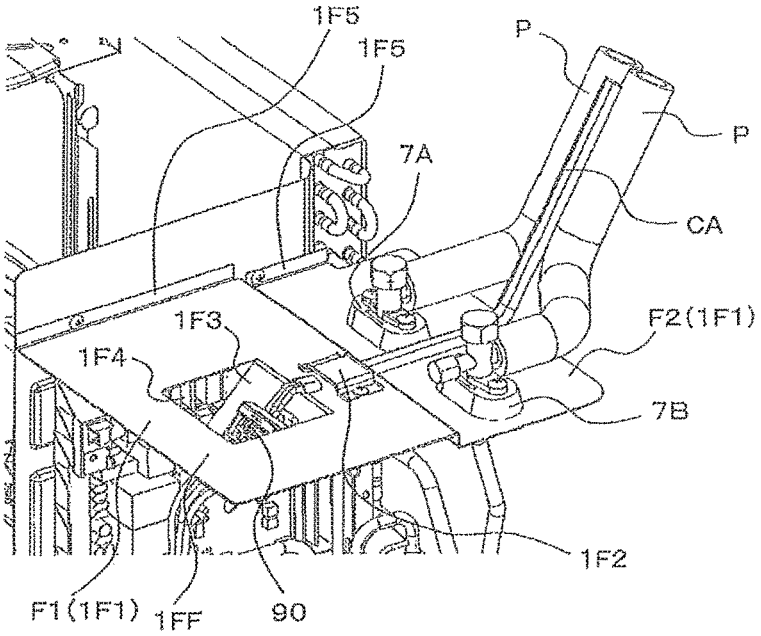
FIG. 2D is a front perspective view of a valve mounting plate of the outdoor unit according to Embodiment 2 of the present invention and a periphery thereof.
Figure 2E:
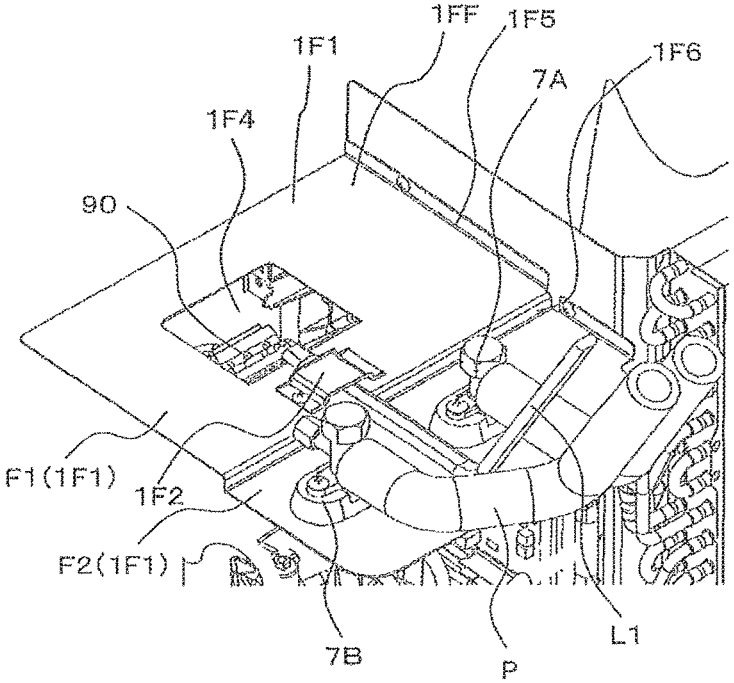
FIG. 2E is a back perspective view of the valve mounting plate of the outdoor unit according to Embodiment 2 of the present invention and the periphery thereof.
Figure 2F:
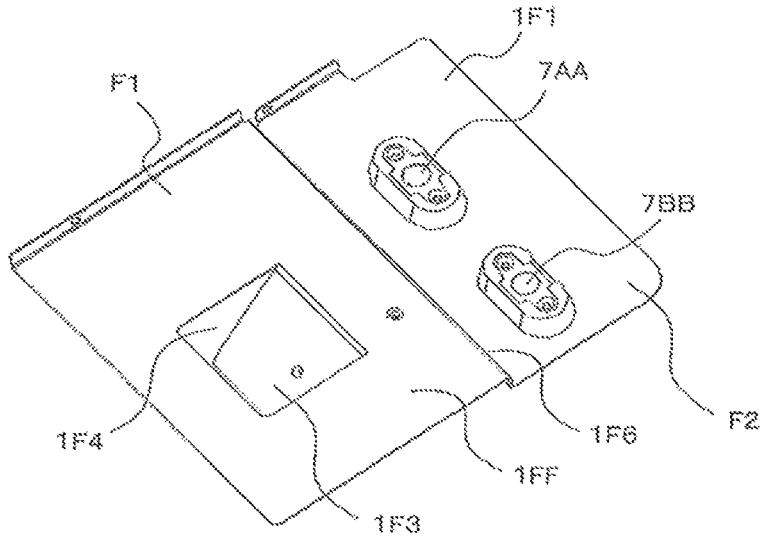
FIG. 2F is a perspective view of the valve mounting plate of the outdoor unit according to Embodiment 2 of the present invention.
Figure 2G:
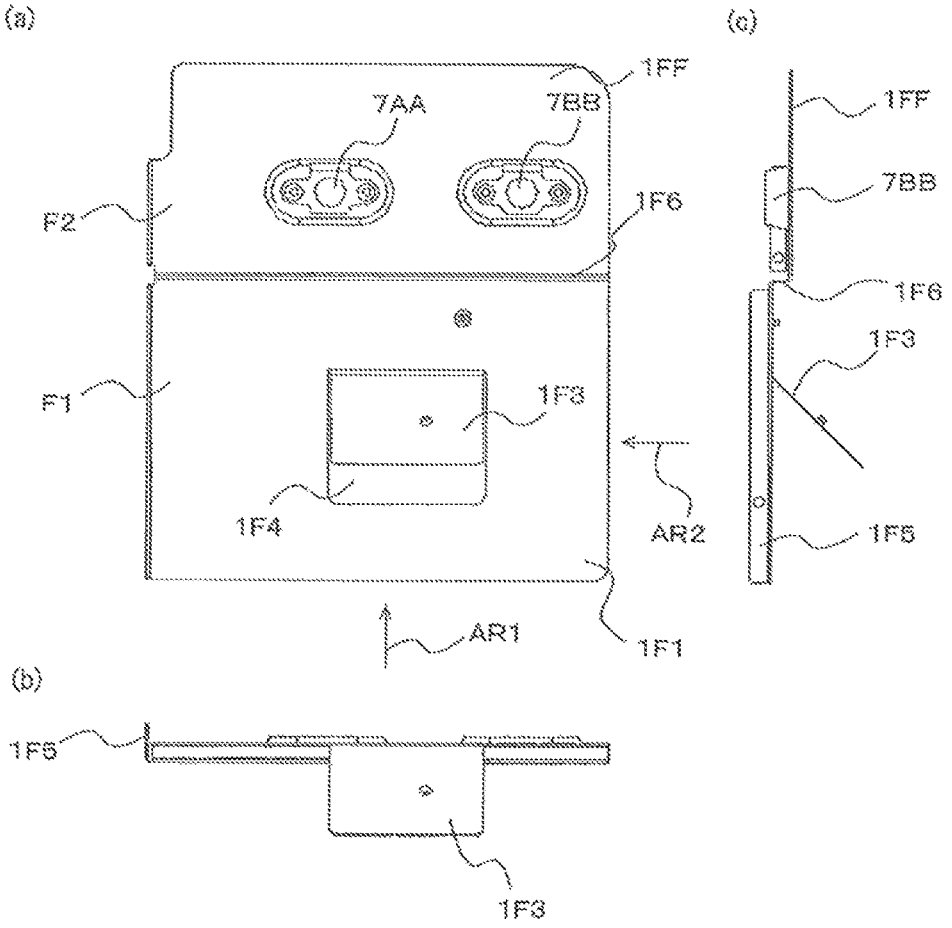
FIG. 2G are explanatory views of the valve mounting plate of the outdoor unit according to Embodiment 2 of the present invention.

FIG. 2D is a front perspective view of a valve mounting plate 1FF of the outdoor unit 100 according to Embodiment 2 and a periphery thereof. FIG. 2E is a back perspective view of the valve mounting plate 1FF of the outdoor unit 100 according to Embodiment 2 and the periphery thereof. FIG. 2F is a perspective view of the valve mounting plate 1FF of the outdoor unit 100 according to Embodiment 2. FIG. 2G are explanatory views of the valve mounting plate 1FF of the outdoor unit 100 according to Embodiment 2. FIG. 2G(a) is a top view of the valve mounting plate 1FF. FIG. 2G(b) is a view of the valve mounting plate 1FF as viewed from a side indicated by the arrow AR1 in FIG. 2G(a), and FIG. 2G(c) is a view of the valve mounting plate 1FF as viewed from a side indicated by the arrow AR2 in FIG. 2G(a).

The valve mounting plate 1FF has a level difference portion 1F6 that is formed so that a mounting surface F2 for the valves 7 becomes lower than a formation surface F1 in which the opening port 1F4 corresponding to the mounting portion is formed. The plate main body 1F1 includes the formation surface F1 and the mounting surface F2.

The level difference portion 1F6 is formed so as to extend from the partition plate 5 side to the side surface portion 1C1 of the second side panel 1C. The fixing member 1F2 is provided on the formation surface F1. Specifically, the terminal block supporting portion 1F3, the opening port 1F4, and the fixing member 1F2 are positioned on one side of the level difference portion 1F6 as a boundary, whereas the valves 7 are positioned on an other side. As described above, the level difference portion 1F6 is formed on the valve mounting plate 1FF. Therefore, dew condensation water generated on the valves 7 cooled by the cooling energy of the refrigerant and a periphery of the valves 7 (for example, on the upper surface of the plate main body 1F1) can be prevented from flowing into the opening port 1F4. As a result, water entering the electrical component box 6 positioned below the opening port 1F4 can be more reliably suppressed.

[Effects of Outdoor Unit 100 according to Embodiment 2]

The outdoor unit 100 according to Embodiment 2 has the following effects in addition to the effects of the outdoor unit 100 according to Embodiment 1.

Specifically, in the outdoor unit 100 according to Embodiment 2, the level difference portion 1F6 is formed on the valve mounting plate 1FF. Therefore, the dew condensation water generated on the valves 7 or other parts can be prevented from flowing into the opening port 1F4. Thus, the water entering the electrical component box 6 can be more reliably suppressed.

The invention claimed is:

1. An outdoor unit connected to an indoor unit through a refrigerant pipe, comprising:

a casing;

a compressor accommodated inside the casing;

a four-way valve accommodated inside the casing and connected to an inlet and an outlet of the compressor via two pipes;

a valve mounting plate positioned in an upper part inside the casing and above the compressor;

an electrical component box provided below the valve mounting plate, the electrical component box includes a controller configured to control a rotation speed of the compressor and control the four-way valve to change a connection of the four-way valve with the compressor;

a valve mounted on the valve mounting plate, to which the refrigerant pipe is connected; and a terminal block to which a first wiring connected on a side of the indoor unit and a second wiring connected on a side of the controller, the valve mounting plate including a mounting portion on which the terminal block is provided, the mounting portion bringing an upper side on which the valve is arranged and a lower side on which the controller is arranged into communication with each other.

2. The outdoor unit of claim 1, further comprising:

an outdoor heat exchanger arranged on a bottom surface of the casing; and a partition plate accommodated inside the casing, and configured to define a side on which the compressor and the electrical component box are provided and a side on which the outdoor heat exchanger is provided, wherein the electrical component box is fixed onto the partition plate.

3. The outdoor unit of claim 2, wherein the valve mounting plate has one end fixed to the partition plate.

4. The outdoor unit of claim 2, wherein the casing comprises:

a top panel arranged above the valve and the terminal block; and a peripheral panel arranged, with respect to the partition plate, on a side of the compressor, the peripheral panel having an upper end portion on which the top panel is mounted, wherein the peripheral panel is positioned on a back surface side of the compressor, and has a cutout portion formed in an upper portion of the valve mounting plate, and through which the refrigerant pipe extends.

5. The outdoor unit of claim 1, wherein the valve mounting plate has a level difference portion formed so that a mounting surface for the valve locates lower than a formation surface in which the mounting portion is formed.

6. The outdoor unit of claim 1, wherein the mounting portion has an opening port configured to bring the upper side on which the valve is arranged and the lower side on which the controller is arranged into communication with each other, and a terminal block supporting portion having one end connected to a peripheral edge of the opening port, and being inclined downward from the one end to an other end, the terminal block supporting portion being provided with the terminal block thereon.

7. The outdoor unit of claim 6, further comprising a fixing member, which is provided on the valve mounting plate, and is configured to fix the first wiring onto the valve mounting plate, wherein the terminal block supporting portion is connected to a portion of the peripheral edge of the opening port, which is positioned on a valve side, and wherein the fixing member is arranged between the valve and a portion at which the peripheral edge of the opening port and the terminal block supporting portion are connected.

8. An outdoor unit connected to an indoor unit through a refrigerant pipe, comprising:

a casing;

a compressor accommodated inside the casing;

a four-way valve accommodated inside the casing and connected to an inlet and an outlet of the compressor via two pipes;

a valve mounting plate positioned in an upper part inside the casing and above the compressor;

an electrical component box provided below the valve mounting plate, the electrical component box includes a controller configured to control a rotation speed of the compressor and control the four-way valve to change a connection of the four-way valve with the compressor;

a valve mounted on the valve mounting plate, to which the refrigerant pipe is connected; and a terminal block to which a first wiring connected on a side of the indoor unit and a second wiring connected on a side of the controller, the valve mounting plate including a mounting portion on which the terminal block is provided, the mounting portion bringing an upper side on which the valve is arranged and a lower side on which the controller is arranged into communication with each other, wherein the mounting portion has an opening port configured to bring the upper side on which the valve is arranged and the lower side on which the controller is arranged into communication with each other, and a terminal block supporting portion having one end connected to a peripheral edge of the opening port, and being inclined downward from the one end to an other end, the terminal block supporting portion being provided with the terminal block thereon.

9. The outdoor unit of claim 8, wherein the mounting portion includes an outer peripheral edge that connects the upper side of the mounting portion to the lower side of the mounting portion to define the outer perimeter of the mounting portion, and the opening port of the mounting portion extends through the upper side of the mounting portion to the lower side of the mounting portion within the outer peripheral edge of the mounting portion.

* * * * *